US006402593B1

(12) United States Patent
Shaw

(10) Patent No.: US 6,402,593 B1
(45) Date of Patent: Jun. 11, 2002

(54) BILAYER SURFACE SCRUBBING

(75) Inventor: James Stephen Shaw, Hampton Falls, NH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/771,854

(22) Filed: Jan. 29, 2001

(51) Int. Cl.[7] ..... B24C 1/00

(52) U.S. Cl. ..... 451/36; 451/38; 451/54; 451/102

(58) Field of Search ..... 451/36, 38, 39, 451/40, 54, 102, 90, 75, 66, 28

(56) References Cited

U.S. PATENT DOCUMENTS 5,146,716 A 9/1992 Lynn
5,207,034 A 5/1993 Lynn
5,234,470 A 8/1993 Lynn
6,165,053 A * 12/2000 Yokokawa et al. ..... 451/53
6,273,788 B1 * 8/2001 Shaw ..... 451/38

OTHER PUBLICATIONS

Sponge–Jet, Inc., "Sponge Blasting System," brochure, 1997.

Sponge–Jet, Inc, "Material Safety Data Sheets," Aug. 30, 1996.

Sponge–Jet, Inc. "Case Histories," undated.

* cited by examiner

*Primary Examiner*—Joseph J. Hail, III
*Assistant Examiner*—Hadi Shakeri
(74) *Attorney, Agent, or Firm*—V. Ramaswamy; Francis L. Conte

(57) ABSTRACT

A fluid stream is discharged along a workpiece surface toward a boss thereof to form a boundary layer atop the surface. A stream of pliant shot is scrubbed across the boss for selectively abrading target material therefrom while the boundary layer protects the surface from abrasion.

23 Claims, 3 Drawing Sheets

BILAYER SURFACE SCRUBBING

BACKGROUND OF THE INVENTION

The present invention relates generally to manufacture and repair of machine parts, and, more specifically, to surface finishing of such parts.

Machines are assemblies of various parts which are individually manufactured and assembled. Machines typically include metal parts, although synthetic and composite parts may also be used. And, each part requires specialized manufacturing.

For example, metal parts may be fabricated from, metal stock in the form of sheets, plates, bars, and rods. Metal parts may also be formed by casting or forging. Such parts may be machined to shape in various manners.

Machining requires the selective removal of material to configure the part to its final shape and size within suitable manufacturing tolerances, typically expressed in mils, and with a suitable surface finish which is typically smooth or polished without blemish.

Each step in the manufacturing process of a given machine adds time and expense which should be minimized for producing a competitively priced product. It is desirable for each subsequent step in the manufacturing process to avoid damaging previously finished portions of the part which would then require additional corrective finishing steps.

Gas turbine engines are an example of a complex machine having many parts requiring precise manufacturing tolerances and fine surface finishes. A typical engine includes a multistage compressor for pressurizing air which is mixed with fuel in a combustor and ignited for generating hot combustion gases which flow downstream through one or more turbine stages that extract energy therefrom. A high pressure turbine powers the compressor, and a low pressure turbine provides output power, such as powering a fan disposed upstream from the compressor in an aircraft engine application.

The engine thusly includes various stationary components, and various rotating components which are typically formed of high strength, state of the art metal and composite materials. The various parts undergo several steps in their manufacturing and are relatively expensive to produce.

Many of these parts are in the form of annular casings having one or more rows of bosses. A typical boss is a raised cylindrical protrusion extending radially outwardly from the surrounding annular surface of the casing. The casing, including its many bosses, may be fabricated or cast to substantially its final size and surface finish except for final machining of the bosses.

For example, a typical compressor casing has many rows of many bosses used for supporting corresponding variable compressor vanes pivotally mounted therein. Each row of bosses is initially cast with excess material, around the common diameter thereof, which excess material is removed in a vertical turning lathe to the required final outer diameter of the boss row.

Each boss is initially solid as cast, and requires subsequent drilling for forming a through-hole in which the spindle of the corresponding compressor vane is later inserted during assembly.

The turning operation typically forms sharp metal burrs along the trailing edges of the bosses, relative to the direction of turning, with the leading edges typically having a relatively sharp 90° corner.

Deburring is required for removing the undesirable burrs, and the remaining sharp are preferably radiused for removing extraneous material therearound.

Since deburring and radiusing are desired around the perimeter edges of each of the several bosses in each of the several axial rows, the geometrical complexity thereof renders impractical automated processing, and therefore deburring and radiusing are typically done by hand. One advantage of hand processing is that the surrounding prefinished surface of the casing is readily protected from any additional material removal therefrom.

But, a significant disadvantage of hand processing is the corresponding amount of time and labor cost associated therewith. And, hand processing is subject to the skill of the operator and performance of the hand-held grinding tools typically utilized which can introduce undesirable nonuniformity from boss to boss. In the worst case, a boss may be damaged beyond repair, which requires scrapping the entire part, with a corresponding loss of money.

Accordingly, it is desired to provide an improved process for treating a workpiece having bosses protruding from a surrounding surface without affecting surface finish thereof.

BRIEF SUMMARY OF THE INVENTION

A fluid stream is discharged along a workpiece surface toward a boss thereof to form a boundary layer atop the surface. A stream of pliant shot is scrubbed across the boss for selectively abrading target material therefrom while the boundary layer protects the surface from abrasion.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
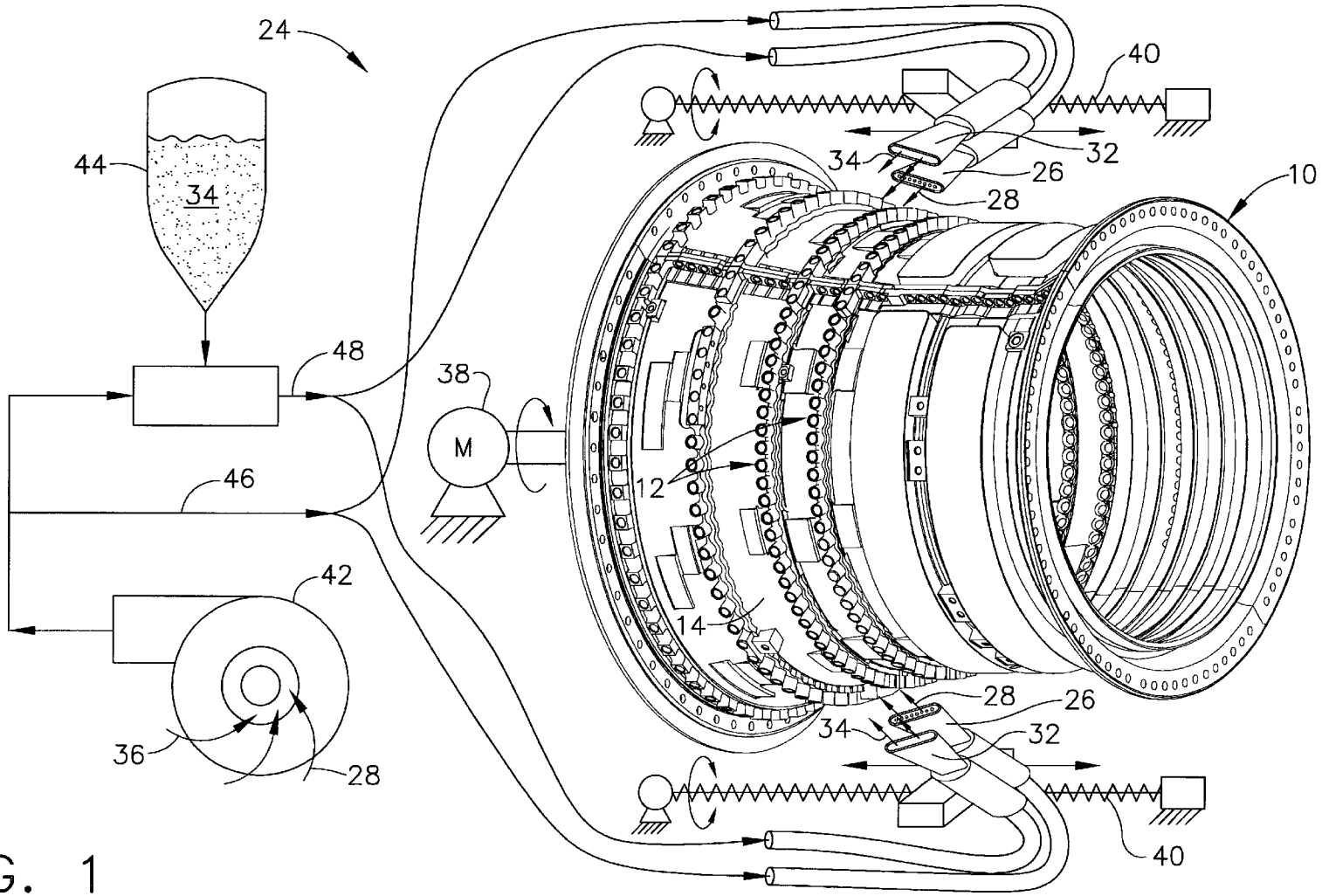
FIG. 1 is an schematic representation of a method of treating a workpiece having protruding bosses in accordance with an exemplary embodiment of the present invention.

Illustrated in FIG. 1 is a workpiece 10 in the exemplary form of annular compressor casing for a gas turbine engine. The casing is typically formed in two 180° halves and bolted together in an annular assembly. The workpiece is formed of suitable metal, although workpieces of different configurations may be used and formed of different materials, such as composites, for example.

The compressor casing may have any conventional configuration and typically includes several annular rows of bosses 12 protruding radially outwardly from a surrounding annular surface 14 of the casing.

Figure 2:
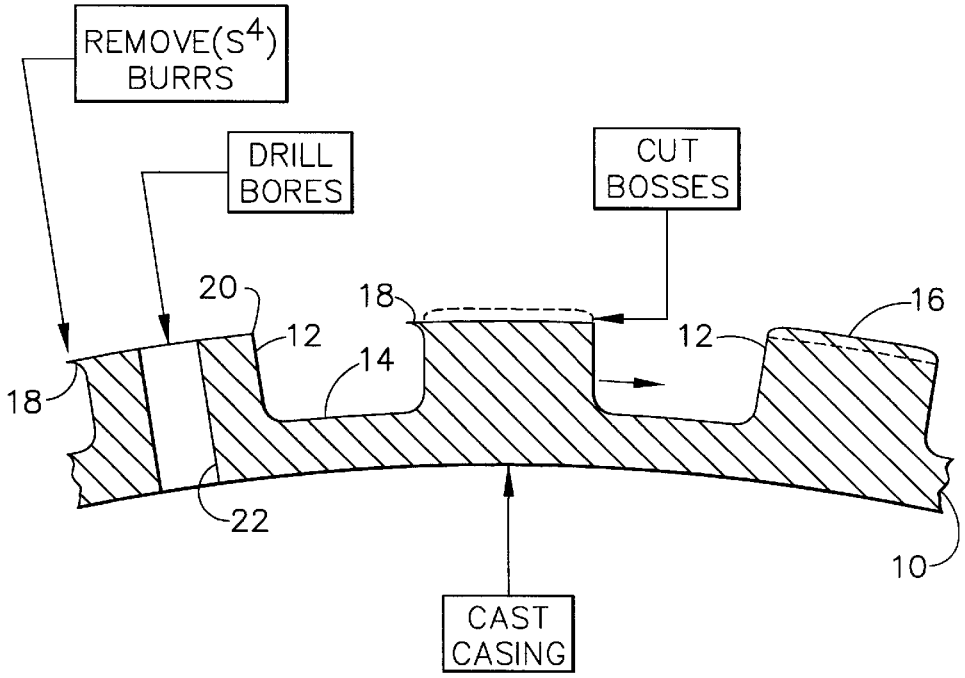
FIG. 2 is an enlarged, partly sectional view, of a portion of the compressor casing illustrated in FIG. 1 illustrating exemplary steps in the manufacture thereof, including removing burrs from the bosses thereof using the apparatus illustrated in FIG. 1.

As shown in FIG. 2, the casing 10 may be formed in any conventional manner, such as being initially cast in its two halves, which are then suitably joined together to form an annular assembly. The exposed outer surface 14 of the casing has a substantially smooth finish following the casting operation and does not require any further material removal therefrom. However, the individual bosses 12 are initially cast solid as cylindrical protrusions extending radially outwardly from the surrounding surface 14, and initially have excess material 16 at their tops.

The compressor casing is conventionally machined in a vertical turning lathe for removing the excess material 16 to form a machined finish atop the individual bosses with a common outer diameter from the centerline axis of the casing. Such machining, however, typically leaves a sharp metal burr 18 along the trailing edge of the remaining corner 20 around the outer perimeter edge of each boss. The leading edge portion of each corner, which is first cut by the lathe tool, is typically without any burr but nevertheless has a relatively sharp 90° corner.

A single hole or bore 22 is suitably drilled centrally through each of the bosses 12 for receiving the spindle of a corresponding compressor vane (not shown) assembled thereto in a later operation.

As indicated above, it is desired to remove all the burrs 18 created during the cutting operation, and it is also desired to radius the sharp corners 20 for removing extraneous material therefrom. And, the deburring and radiusing operations are preferably effected without removing any material around the remainder of the individual bosses or any material from the casing surface 14, and without affecting the original surface finish thereof.

As illustrated in FIG. 1, an apparatus 24 is provided for practicing the method of treating the compressor casing workpiece 10 in accordance with an exemplary embodiment of the present invention. As indicated above, the casing 10 includes a plurality of rows of the bosses 12 axially spaced apart from each other, with each row including a multitude of bosses circumferentially spaced apart from each other around the circumference of the casing in the two halves thereof. The many bosses 12 protrude radially outwardly from the surrounding annular surface 14, and it is desired to treat the bosses without treating or affecting the surface finish of the surrounding surface or removing any material therefrom.

Figure 3:
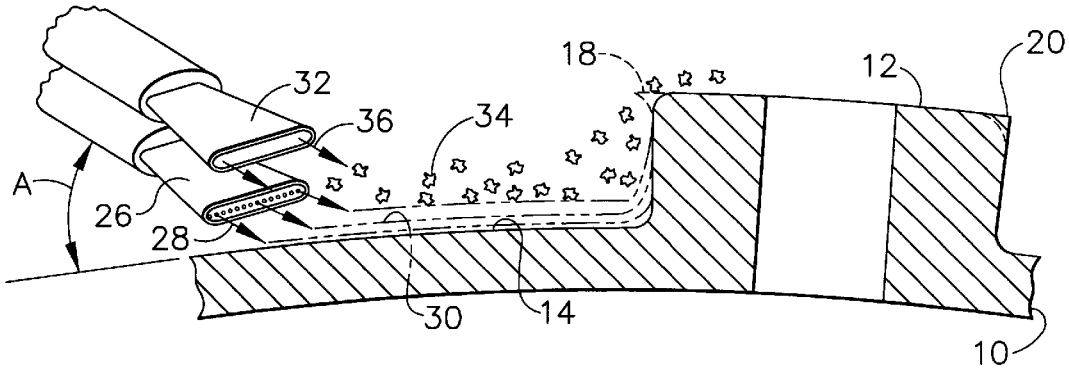
FIG. 3 is a further enlarged, partly sectional view of an exemplary one of the bosses illustrated in FIG. 1 showing surface scrubbing thereof in accordance with an exemplary embodiment of the present invention.

Means including a first nozzle 26 are provided for discharging a fluid stream 28 along the surface of the casing toward at least one of the individual bosses to form a protective boundary layer 30 atop the surface as illustrated in more detail in FIG. 3.

As shown in FIGS. 1 and 2, additional means including a second nozzle 32 are provided for scrubbing a stream of pliant shot 34 across the width of the boss 12 for selectively abrading or removing target material therefrom in the exemplary form of the burr 18, while the boundary layer 30 protects the surrounding casing surface 14 from abrasion by the shot.

In the preferred embodiment illustrated in FIGS. 1 and 3 the stream of shot 34 includes a multitude of particulate shot discharged in a suitable carrier fluid 36 in a layer atop the fluid stream 28 which form, overlapping or bilayer streams directed toward the target burrs 18 on the upstream side of the boss being treated.

The purpose of the fluid stream 28 illustrated in FIG. 3 is to provide a protective boundary layer 30 directly atop the surface of the casing to be protected, with the shot being discharged atop the protective layer until they impact and scrub away the intended target material. The protective layer 30 may be formed in any suitable manner by discharge from the first nozzle 26.

Preferably, the stream of shot 34 is discharged at a shallow angle of incidence A toward the casing surface on the upstream side of the boss so that the shot stream rides laterally and generally parallel to the underlying casing surface atop the protective layer 30 until it impinges against the target burr 18 for successively removing material therefrom until the burr is completely removed.

The shot 34 illustrated in FIG. 3 may be formed of any suitable material having the ability to abrade the target material whether the target or shot is metal or not. The shot is preferably pliant or soft so that when it is discharged with its carrier fluid it rebounds little if any along its scrubbing path. The carrier fluid 36 entrains the shot for maintaining a layered stream thereof as it is directed toward the burrs 18.

However, the larger the incidence angle A for the pliant shot, the greater will be the tendency of the shot to abrade the casing surface 14 if used without the protective air layer. Accordingly, shallow angles of incidence A are preferred to minimize the tendency of the abrasive shot to abrade the underlying casing surface 14. The incidence angle A is preferably about 30°, although it may range up to 45° or even 60°, with the limit of the incidence angle A being that angle at which the pliant shot would abrade the casing surface 14, which is undesirable in the preferred embodiment.

By introducing the protective boundary layer 30 over the casing surface 14, that surface has enhanced protection from the abrasive effect of the shot 34. As shown in FIG. 3, the two nozzles 26,32 may be mounted in tandem or piggyback to each other at the common angle of incidence A, with the first nozzle 26 first laying down the protective boundary layer 30 upon which the pliant shot 34 may ride during operation.

The small angle of incidence ensures that the pliant shot is carried generally parallel over the casing surface 14 which is protected therefrom by the intervening boundary layer 30. The incidence angle A may be selected in conjunction with the strength of the boundary layer to prevent penetration of the shot therethrough to the underlying surface being protected.

However, since the boss 12 protrudes outwardly from the underlying casing surface 14, it positions its cylindrical surface and the burrs 18 generally normal to the flow direction of the pliant shot. As shown in FIG. 3, the protective layer 30 will necessarily split around both sides of the protruding boss 12 as well as rise upwardly over the outer corner thereof where it substantially diminishes in go thickness and protective effect. The pliant shot 34 may then impinge the outer portion of the boss substantially normal to the upstream edge thereof to breach any remaining boundary layer and abrade any burr 18 found thereon.

Although the boss itself is cylindrical, the impingement angle of the shot remains locally normal or about 90° to the outwardly extending burrs for effective removal thereof.

In this way the exposed upstream portion of the individual boss 12 may be selectively abraded while the surrounding casing surface 14 and lower portion of the individual bosses is protected from abrasion by the boundary layer 30. This improved. process is known as Selective Sustained Surface Scrubbing ($S^4$) for the selective or local effect of the pliant shot 34 as it is sustained in a stream for scrubbing any target material, such as the burr 18, within its impingement path. This process is also referred to as: bilayer surface scrubbing since the boundary layer 30 is formed atop the casing surface for protection thereof as the shot stream layer is carried atop the protective layer.

Since the abrasion effect of the pliant shot 34 is directionally sensitive for target material within its impingement flowpath, the shot stream 34 and the protective fluid stream 28 are initially discharged in a first direction toward the boss 12 as illustrated in FIG. 3 for abrading target material from the corresponding first or upstream side thereof. The downstream side of the boss is hidden within the shadow or wake thereof, and is unaffected by the shot as it rebounds harmlessly away from the boss and remainder of the casing.

In order to fully scrub the entire perimeter of the boss 12, the shot stream 34 and protective stream 28 may then be discharged in a second direction toward the boss for abrading target material from a corresponding opposite second side thereof. In FIG. 3, the first direction would be from left to right, with the second direction being from right to left.

This is illustrated in FIG. 1 wherein two sets of the nozzles 26,32 are suitably mounted in the apparatus for directing their respective shot and fluid streams toward opposite circumferential sides of each of the bosses in turn as the casing is rotated.

More specifically, means including a suitable motor 38 are operatively joined to the annular casing 10 using a suitable shaft and arbor mounting the casing coaxially therewith, with the motor being effective for rotating the casing around its centerline axis at any suitable speed such as about 10 rpm. The motor 38 is then effective for rotating the casing 10 to sequentially position the individual bosses 12 in turn within the bilayer shot and fluid streams from the two nozzles 26,32 for scrubbing away the intended target material therefrom.

In the preferred embodiment illustrated in FIG. 1, the two sets of nozzles 26,32 are preferably mounted on diametrically opposite sides of the casing for discharging their respectively bilayer shot and fluid streams in opposite directions toward the common row of bosses 12 for scrubbing correspondingly opposite sides thereof. For example, the two sets of nozzles may be inclined at the same angles of incidence relative to the casing surface in opposite tangential directions around the casing.

In this way, as the casing rotates slowly between the two nozzle sets, the leading edge half of each boss will be treated by one nozzle set such as the top set illustrated in FIG. 1, with the trailing edge portions of the bosses being treated by the second nozzle set at the bottom of FIG. 1. The casing may be rotated a sufficient number of revolutions so that the two nozzle sets have sufficient time to fully treat the entire row of bosses within their field of coverage for removing any burrs thereon, as well as additionally radiusing the exposed corners of the bosses as desired.

For the exemplary compressor casing illustrated in FIG. 1, a plurality of rows of the bosses 12 are axially spaced apart from each other, and surface treating of all the bosses thereof is desired. Accordingly, additional means in the exemplary form of motor powered lead screws 40 are used to axially support the two nozzle pairs for axially translating the bilayer shot and fluid streams discharged therefrom axially across several rows of bosses for sequential scrubbing thereof.

Each boss row may be scrubbed until the bosses are deburred and radiused as desired, with each additional row being scrubbed in turn. Or, the nozzles may be axially translated from row to row as the casing rotates to scrub the bosses in part from row to row until a sufficient number of rotations of the casing occur with a sufficient number of axial reciprocation of the nozzle pairs is obtained at which time all of the bosses of all of the rows are suitably deburred and radiused as desired.

As indicated above, the intended target, at each boss may be any burr 18 found along the perimeter edge thereof. The protective fluid stream 28 is split around each boss below the corresponding burr during the scrubbing process so that the shot stream being directed toward the boss breaches the protective layer where it thins due to such splitting for deburring the boss down to its underlying external corner.

As shown in FIG. 3, the intended target may also be the sharp corner 20 itself, with or without any burrs thereon, and the scrubbing process may be used in the same manner as that for removing the burrs for removing parent material and radiusing the exposed external corner to a suitable radius. In either case, the protective layer splits as it flows around the cylindrical boss and loses its protective effect at the perimeter edge of the boss which may then be abraded by the pliant shot for removing the burr, as well as additionally radiusing the remaining corner as desired.

In the preferred embodiment illustrated in FIG. 1, the carrier fluid 36 is preferably air suitably pressurized by a compressor 42 for discharge with the shot 34 through the first nozzle 26.

Equipment for discharging the pliant shot is commercially available from U.S. Technology, Inc. of Canton, Ohio and includes a suitable hopper 44 in which the pliant shot 34 is initially stored. The hopper is joined in flow communication with a second delivery conduit 48 having an ejector chamber which entrains the pliant shot with the pressurized air for delivery through the conduit for discharge from the corresponding second nozzle 32.

The compressor 42 may be joined both to the second delivery conduit 48 and a first delivery conduit 46 joined to the corresponding first nozzle 26. In this way, air under suitable pressure may be used for both the protective air stream discharged from the first nozzle 26 and carrying the pliant shot through the second nozzle 32 for use in scrubbing the casing bosses.

Various forms of the pliant shot 34 are also commercially available from U.S. Technology, Inc. and preferably comprise a light-weight, resilient material such as sponge, rubber, felt, plastic, foam, or other resilient material. The shot preferably has a cellular construction with open or closed cells. In a preferred embodiment the shot comprises closed cell sponge polyurethane permitting multiple re-use without plugging of target material therein.

Figure 4:
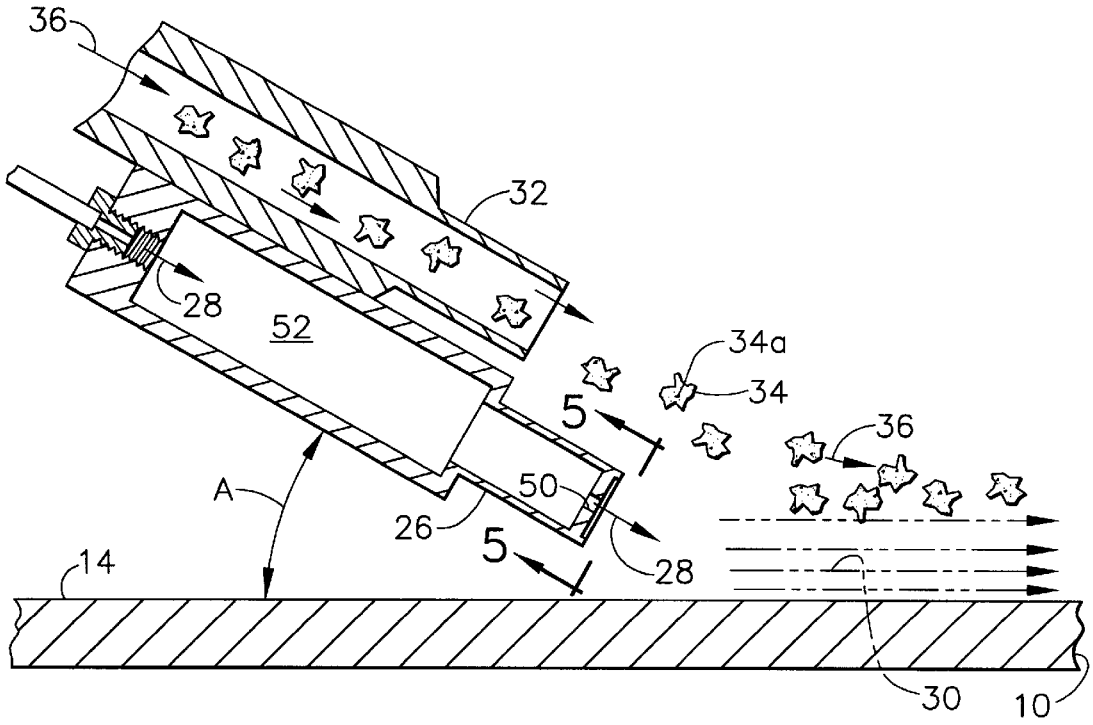
FIG. 4 is a partly sectional elevational view of the two nozzles illustrated in FIG. 3 for discharging corresponding streams of pliant shot and protective fluid along, the surface of the workpiece for selectively abrading the bosses thereof while protecting the underlying casing surface.

The shot 34 preferably also includes abrasive particles 34*a* as illustrated in more detail in FIG. 4, embedded therein, although in alternate embodiments abrasive may be omitted. Suitable abrasives include particles of various minerals, metal oxides, plastics, and black walnut shell, for example.

A particular advantage of the sponge media used for the scrubbing shot is its ability to resist rebound when discharged toward the casing surface for sustaining its lateral or sideways movement direction parallel over the surface until it impinges the protruding edge of a corresponding boss. The light-weight sponge is entrained in its carrier air 36 and effectively floats atop the protective boundary layer 30 until impinging the exposed perimeter of the individual bosses.

As shown in FIGS. 1 and 3, the first nozzle 26 is preferably configured for discharging a relatively wide stream of air 28 across the width of the boss 12 being scrubbed. Similarly, the second nozzle 32 is also configured for discharging a wide stream of the pliant shot 34 in its carrier air 36 across the width of the boss in a bilayer with and atop the air stream 28 forming the boundary layer 30. In this way, each of the bilayer shot and air streams is discharged from the respective nozzles toward the casing surface upstream of the intended boss in laterally wide overlapping streams.

Figure 5:
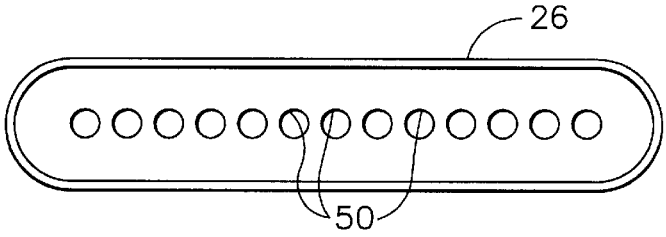
FIG. 5 is an end view of the protection nozzle illustrated in FIG. 4 and taken along line 5—5 in accordance with an exemplary embodiment thereof.

As shown in more detail in FIGS. 4 and 5, the first nozzle 26 preferably includes a linear row of outlet holes 50 formed in the discharge end of an annular manifold 52 for discharging corresponding jets of the protective air to form a relatively wide air stream discharged therefrom. The first nozzle 26 may have an oval outlet end through which the several jets of air are discharged from the outlet holes 50 in a laterally wide spray pattern toward the casing surface.

Correspondingly, the second nozzle 32 preferably includes a single outlet hole which is also oval, being wider than it is tall in height. The two oval discharge orifices of the two nozzles 26,32 illustrated in FIG. 3 suitably spread the respective streams therefrom for maximizing the effective coverage area of the scrubbing shot.

As shown in FIG. 1, the common compressor 42 may be used for suitably pressurizing the air for use both as the protective air stream 28 and carrier air stream 36 under suitable pressure. In the preferred embodiment, the protective air 28 is channeled to the nozzle manifold 52 under relatively high pressure of about 90–110 psi, whereas the carrier air 36 has a relatively low pressure of about 30–40 psi for carrying the pliant shot through the second nozzle.

The lower pressure air may be obtained by using a suitable pressure reducer from the common compressor, or independent compressors. Or, available pressurized shop air may be used for the corresponding nozzles. The high pressure air provided to the first nozzle 26 cooperates with the small outlet holes 50 thereof for providing effective air jets which spread laterally as they are discharged from the nozzle. Any suitable number of outlet holes 50, such as 10–15, may be used in the first nozzle 26 with a suitable diameter, of about 43 mils for example.

The resulting first nozzle 26 discharges high velocity air in a blanket or boundary layer for protecting the underlying casing surface around the individual bosses 12 protruding outwardly therefrom. The second nozzle 32 discharges relatively low velocity air entraining therein the light-weight pliant shot 34 which floats atop the protective air layer until it impinges the perimeter edges of the boss for deburring or radiusing thereof as desired.

The resulting apparatus and method illustrated in FIG. 1 provide a relatively simple and effective automated arrangement for effectively deburring and radiusing the many casing bosses in a relatively short time, with a substantial reduction in cost over hand deburring and hand radiusing. Deburring and; radiusing is effected with substantial uniformity from boss to boss, and with minimal or no risk of damaging or changing the underlying surface finish of the exposed casing surface.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

1. A method of treating a boss protruding from a surrounding surface of a workpiece comprising:

discharging a fluid stream along said surface toward said boss to form a boundary layer atop said surface; and scrubbing a stream of pliant shot across said boss for selectively abrading target material from a target thereat while said boundary layer protects said surface from abrasion.

2. A method according to claim 1 wherein said stream of shot is discharged at a shallow angle of incidence toward said surface upstream from said boss to ride atop said boundary layer in impingement against said target for removing material therefrom.

3. A method according to claim 2 further comprising discharging said stream of shot in a carrier fluid atop said fluid stream in bilayer streams toward said target.

4. A method according to claim 3 further comprising:

discharging said shot stream and fluid stream in a first direction toward said boss for abrading said target material from a corresponding first side thereof; and discharging said shot stream and fluid stream in a second direction toward said boss for abrading said target material from a corresponding second side thereof.

5. A method according to claim 3 wherein said workpiece further includes a row of said bosses circumferentially spaced apart from each other, and further comprising rotating said workpiece to sequentially position said bosses within said bilayer shot and fluid streams for scrubbing away said target material therefrom.

6. A method according to claim 5 further comprising discharging two bilayer shot and fluid streams in opposite directions toward said row of bosses for scrubbing corresponding opposite sides thereof.

7. A method according to claim 6 wherein said workpiece further includes a plurality of rows of said bosses axially spaced apart from each other, and further comprising axially translating said bilayer shot and fluid streams across said boss rows for scrubbing thereof.

8. A method according to claim 3 wherein:

said target comprises a burr along a perimeter edge of said boss;

said fluid stream is split around said boss below said burr; and said shot stream is directed toward said boss for deburring thereof.

9. A method according to claim 3 wherein:

said target comprises a corner along a perimeter edge of said boss;

said fluid stream is split around said boss below said corner; and said shot stream is directed toward said boss for radiusing said corner.

10. A method according to claim 3 wherein:

said carrier fluid comprises air discharged under pressure with said shot therein; and said fluid stream comprises air discharged under pressure, and being devoid of said shot.

11. A method according to claim 10 wherein shot comprises cellular sponge.

12. A method according to claim 11 wherein said shot further comprises abrasive particles embedded therein.

13. A method according to claim 12 wherein sponge shot comprises polyurethane.

14. A method of treating a casing having rows of bosses protruding radially outwardly from a surrounding surface comprising:

discharging a fluid stream along said surface toward at least one of said bosses to form a boundary layer atop said surface;

scrubbing a stream of pliant shot across said one boss for selectively abrading target material from a target thereat while said boundary layer protects said surface from abrasion; and rotating said casing to sequentially scrub each of said bosses for removing corresponding said target material therefrom.

15. A method according to claim 14 wherein:

said target comprises a burr along a perimeter edge of said one boss;

said fluid stream is split around said one boss below said burr; and said shot stream is directed toward said one boss for deburring thereof.

16. A method according to claim 15 wherein:

said target further comprises a corner along said perimeter edge of said boss; and said shot stream is directed toward said corner for radiusing thereof.

17. A method according to claim 15 wherein said stream of shot is discharged at a shallow angle of incidence toward said surface upstream from said one boss to ride atop said boundary layer in impingement against said target for removing material therefrom.

18. A method according to claim 17 wherein:

said shot stream comprises air discharged under pressure with said shot therein; and said fluid stream comprises air discharged under pressure, and being devoid of said shot.

19. A method according to claim 18 wherein:

said shot comprises cellular polyurethane sponge having abrasive particles embedded therein; and each of said shot and fluid streams is discharged toward said surface in laterally wide overlapping streams.

20. An apparatus for treating a boss protruding from a surrounding surface of a workpiece comprising:

means for discharging a fluid stream along said surface toward said boss to form a boundary layer atop said surface; and means for scrubbing a stream of pliant shot across said boss for selectively abrading target material therefrom while said boundary layer protects said surface from abrasion.

21. An apparatus according to claim 20 wherein:

said discharging means comprise a first nozzle for discharging a wide stream of air across the width of said boss; and said scrubbing means comprise a second nozzle for discharging a wide stream of said pliant shot in an air carrier across the width of said boss in a bilayer atop said air stream.

22. An apparatus according to claim 21 further comprising means for rotating said workpiece to sequentially position respective bosses thereof within said bilayer shot and air streams for scrubbing away said target material therefrom.

23. An apparatus according to claim 22 wherein:

said first nozzle includes a row of outlet holes for discharging corresponding jets of air to form said wide air stream; and said second nozzle includes a single outlet hole being wider than tall.

* * * * *